United States Patent [19]

Vuletic

[11] Patent Number: 4,898,366

[45] Date of Patent: Feb. 6, 1990

[54] APPARATUS FOR CHARGING A MELTING GASIFIER WITH GASIFICATION MEDIA AND SPONGE IRON

[75] Inventor: Bogdan Vuletic, Duesseldorf, Fed. Rep. of Germany

[73] Assignee: Deutsche Voest-Alpine Industrieanlagenbau GmbH, Duesseldorf, Fed. Rep. of Germany

[21] Appl. No.: 216,729

[22] Filed: Jul. 8, 1988

[30] Foreign Application Priority Data

Jul. 13, 1987 [DE] Fed. Rep. of Germany ..... 3723137

[51] Int. Cl.[4] ..... F27B 1/20

[52] U.S. Cl. ..... 266/160; 266/172; 266/175; 266/183; 266/195; 266/176

[58] Field of Search ..... 266/160, 171, 172, 175, 266/176, 195, 183

[56] References Cited

U.S. PATENT DOCUMENTS

| | | | |
|---|---|---|---|
| 2,368,508 | 1/1945 | Wile | 266/175 |
| 4,005,857 | 2/1977 | Colautti | 266/195 |
| 4,270,740 | 6/1981 | Sanzenbacher et al. | 266/157 |
| 4,286,775 | 9/1981 | Scarlett et al. | 226/147 |
| 4,316,739 | 2/1982 | Beggs et al. | 75/40 |
| 4,448,402 | 5/1984 | Weber et al. | 75/38 |
| 4,605,205 | 8/1986 | Langner et al. | 266/160 |

FOREIGN PATENT DOCUMENTS 3026949 2/1981 Fed. Rep. of Germany .

*Primary Examiner*—Melvyn J. Andrews
*Attorney, Agent, or Firm*—Barnes & Thornburg

[57] ABSTRACT

An apparatus for charging a melting gasifier (2) with gasification media and with sponge iron discharged from a direct reduction shaft furnace (1) arranged above the melting gasifier is described. This comprises inlets and outlets in the lower part of the shaft furnace, connecting lines (4) in the form of downcomers between the shaft furnace and the gasifier in the upper region of the latter, symmetrically to the longitudinal axis of the shaft furnace and/or the gasifier and discharge means (7) for the sponge iron, such as screw conveyors or the like aligned radially to said longitudinal axis. The connecting lines at least approximately vertically issue into the lowermost, substantially horizontal base region of the shaft furnace. The discharge means are arranged at the melting gasifier inlets (9) in the discharge direction behind the connecting lines and the gasification medium inlet (3) is located in the longitudinal axis of the melting gasifier immediately adjacent to the sponge iron inlets. The sponge iron and gasification medium inlets are preferably located within a melting gasifier dome (5).

4 Claims, 1 Drawing Sheet

Figure 2:
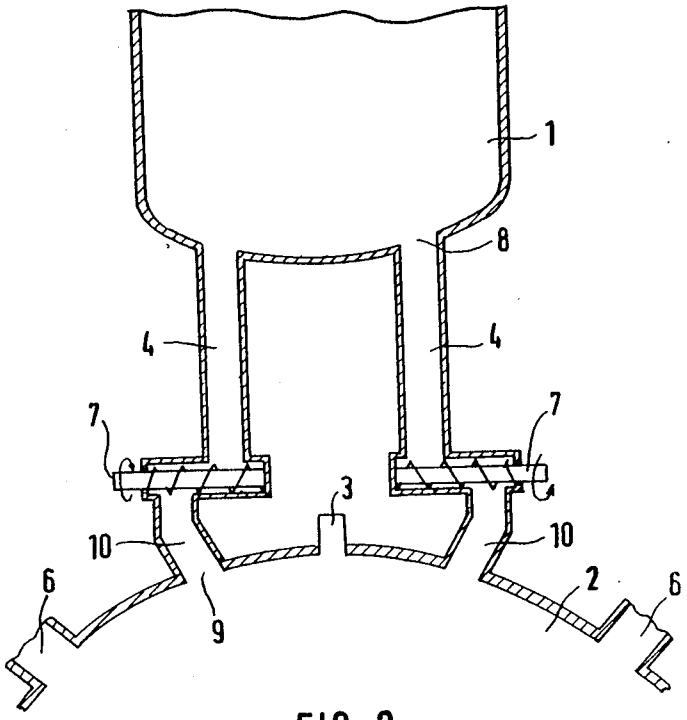

APPARATUS FOR CHARGING A MELTING GASIFIER WITH GASIFICATION MEDIA AND SPONGE IRON

This invention relates to the combination of a direct reduction furnace producing sponge iron, a melting gasifier for further processing the sponge iron, and apparatus for withdrawing the sponge iron from the direct reduction furnace and introducing it into the melting gasifier.

Such apparatuses are already known (German Pat. No. 30 34 539), where the direct reduction shaft furnace is arranged in spaced manner above and aligned with the melting gasifier. A plurality of radially arranged discharge means in the form of screw conveyors are arranged in the lower region of the shaft furnace in horizontal form and are guided at right angles through the circumferential wall thereof. These discharge means discharge the sponge iron via associated downcomers from said region of the shaft furnace, from where it is supplied by means of the downcomers directly into the melting gasifier. The downcomers end in the top region of the melting gasifier centrally around its central axis and at a distance therefrom and from one another. Immediately alongside the inlet connections of said connecting lines are provided the inlet openings for the gasification media, preferably coal, as well as the outlets for the reduction gas or the crude gas leaving the melting gasifier.

The melting gasifier is directly connected to the reduction shaft furnace via the downcomers. Thus, apart from the gasifier gas from which the dust has not been removed, in this way a large amount of dust is introduced into the reduction shaft furnace. In order to reduce the amount of dust and limit the resulting problems, the reduction gas intake to the reduction shaft furnace is located at least 2 m above the feed screws, the packed bed in said area serving as a gas barrier. Thus, the height of the reduction shaft furnace is approximately 2 m greater than is necessary.

Due to the fact that in their radial arrangement the feed screws issue into the vertically directed wall portions in the lower region of the reduction shaft furnace, a dead space is formed between the thus defined plane within the furnace shaft and its underlying furnace bottom from which the sponge iron cannot be conveyed, i.e. uneconomically does not participate in the process sequence. This dead space necessarily also increases the distance between the shaft furnace and the melting gasifier positioned below it and in this way extends the connecting lines between the discharge ends of the feed screws and the melting gasifier. This not inconsiderable length of the connecting lines or downcomers (approximately 10 m in the case of a plant with 300,000 t/year) between the shaft furnace and the gasifier can lead to undefined conditions for the movement of the sponge iron through the downcomers, because on the one hand the iron particles can be accelerated in substantially free fall manner (in the case of smaller feed quantities) from the discharge end of the feed screws located directly at the shaft furnace wall and then to the inlet end of the downcomers in the gasifier and then penetrate at high speed the melting gasifier and its lower coal fluidized bed. However, in the case of large feed quantities through the screw conveyors, as a result of the hot reduction gases flowing in counterflow manner to the direction of movement of the iron particles through the connecting lines, the iron particles can cake in the latter. It has also been found that a uniform distribution and mixing of the melting gasifier charge between the gasification media and a hot sponge iron is not or is not adequately ensured in the vicinity of the coal fluidized bed in this arrangement. This lack of homogeneity in the charge has a particularly disadvantageous effect in the centre of the gasifier.

Due to the fact that in the top region of the melting gasifier the outlets for the crude gas are located immediately alongside the inlets for the gasification medium on the one hand and the sponge iron on the other, the amount of dust produced at the reduction gas outlets is particularly high and the crude gas also contains a large amount of fine dust. Due to the fact that the discharge means are located upstream of the downcomers in the sponge iron feed direction between the shaft furnace and the melting gasifier, namely directly in the side walls of the furnace, there is a volume-based forced control of the sponge iron quantity passing through the downcomers, which leads to a considerable amount of wear within the downcomers. This also leads to a limitation in the throughput capacities of the feed screws and also as a result of the fact that they are only mounted on the one side, so that this in itself limits the size and effectiveness of the overall plant.

The problem of the present invention is therefore to improve an apparatus of the aforementioned type in such a way that the aforementioned disadvantages resulting from the considerable length of the connecting lines between the shaft furnace and the gasifier and the nature of the connections thereof in the lower region of the shaft furnace and in the top region of the gasifier are avoided. According to the invention this problem is solved by providing an apparatus for charging the sponge iron inlets of the melting gasifier with sponge iron from the sponge iron outlets located in the lower most end of the direct reduction furnace including a plurality of connecting lines symmetrically arranged about the vertical longitudinal axis of the melting gasifier, each connecting line comprising a vertical conduit having an inlet end connected to the direct reduction furnace and having an outlet end connected to a first end of a substantially horizontal conduit, the substantially horizontal conduit having a second end connected to an inlet on the melting gasifier and discharge means situated within each of the horizontal conduits for assisting the delivery of the sponge iron from the lower end of the vertical portion of the connecting line to the melting gasifier.

Due to the fact that the connecting lines for discharging the sponge iron from the direct reduction shaft furnace issue vertically into its lowermost base region, it is possible to completely avoid the hitherto unavoidable, as a result of the lateral screw discharge, dead volume for the sponge iron in the shaft furnace and at least by this amount the latter can be positioned closer to the melting gasifier. This leads to a not inconsiderable reduction in the length of the connecting lines and there is a greater variation possibility, more advantageously adaptable to needs with regards to the direct guidance of the connecting lines between the shaft furnace and the gasifier with the possibility of a more uniform distribution and mixing of the burden supplied to the melting gasifier and in particular relative to the centre of the gasifier.

The gasification medium inlets concentrated close to the longitudinal axis of the melting gasifier and which are substantially combined on the one hand and the hot sponge iron on the other ensures that the dust fraction mainly occurring in the intake region for the coal or coke dust is to a certain extent adsorbed and entrained by the entering sponge iron, so that much less dust is produced, particularly in the top region of the melting gasifier. The fines fraction removed with the crude gas through the gas outlets in the melting gasifier is reduced still further, because the distance between the reduction gas outlets and the centrally combined inlet openings for the gasification media and the hot sponge iron are much further apart in the selected arrangement than could be the case in the known apparatus.

Due to the fact that the feed screws are no longer positioned directly at the direct reduction shaft furnace and therefore in the direction of movement of the hot sponge iron upstream of the downcomers and instead are located at the end of said connecting lines directly upstream of the entry of the sponge iron into the melting gasifier, the loading of the downcomers and the reduction unit with the preheated fines is additionally reduced, because said dust is separated initially in the screw channels of the discharge means and from there is immediately conveyed back over the shortest path to the gasifier. The reduction shaft furnace is made approximately 2 m shorter, because the dust and gas barrier between the feed screws and the gas intake is no longer required. The low sinking speeds in the pipes resulting from the drawing of the hot sponge iron through the connecting lines of approximately 0.003 m in the case of four downcomers with an internal diameter of 0.8 m leads to a considerable reduction to the hitherto observed wear in such downcomers. The shorter and/or smaller diameter feed screws require less energy, which leads to a further advantage of this arrangement.

Reduction of the overall height of the complete plant, reduction of the shaft furnace volume, reduced repair susceptibility and more reliable operation of the feed screws leads to a more economic operation at reduced cost.

Figure 1:
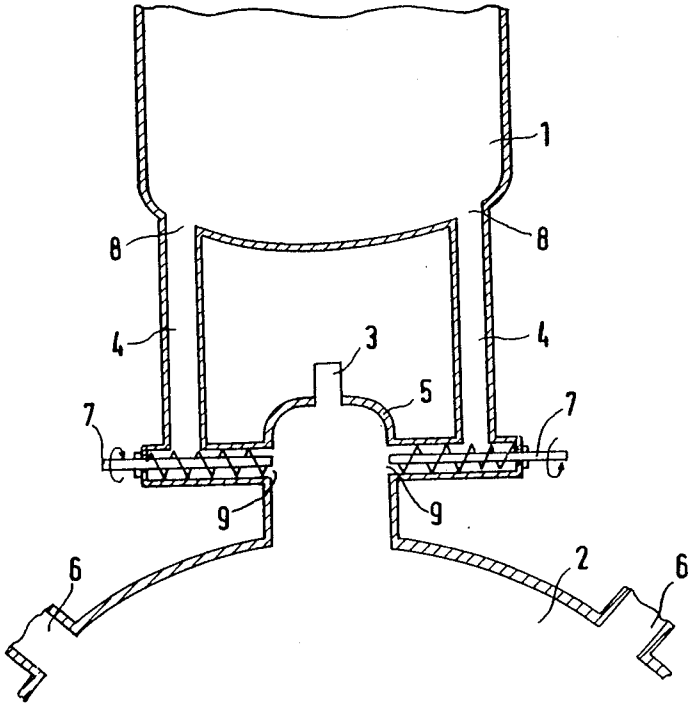

The invention is described in greater detail hereinafter relative to two embodiments and the attached drawings in the form of partial longitudinal sections and wherein show:

FIG. 1 A section through an inventive apparatus, in which the inlets for the gasification media and the hot sponge iron issue into a dome.

FIG. 2 A representation according to FIG. 1 in which, in place of the dome, there are short additional pipe sockets, which connect the screw conveyor with the interior of the top region of the melting gasifier.

The direct reduction shaft furnace is only shown in the diagrammatic drawing with respect to its lower base region, whilst only the top container region of the melting gasifier 2 is shown. The connecting lines 4 arranged substantially vertically between the direct reduction shaft furnace 1 and the melting gasifier 2 issued directly into the horizontally or slightly convex base of the shaft furnace. Only two of the connecting lines 4 are shown in the sectional representation, but in known manner there is a plurality of such downcomers spaced from one another along a ring-shaped area, whose centre forms the longitudinal axis of the shaft furnace. Independently of the distance of the sponge iron outlets 8 from the central axis thereof, the connecting lines 4 in each case terminate at a distance from the vertical side walls of the shaft furnace and with the end thereof remote from outlet 8 in the inlet region of an associated discharge means 7 in the form of a screw conveyor for each connecting line 4. The screw conveyors or feed screws are arranged radially and horizontally with respect to the longitudinal axis of shaft furnace 1 or melting gasifier 2 and from the shaft furnace connect the downcomers to inlets 9 in melting gasifier 2.

The minimum length of the connecting lines 4 should be selected in such a way that the sponge iron column received by them withstands the pressure difference between the shaft furnace and the gasifier and i.e. serves as a barrier member between the same. This minimum length should be at least 2 m. In addition, the internal diameter of the connecting lines 4 should be such that arching by the sponge iron is reliably prevented. Thus, preferably internal diameters of at least 0.5 m and e.g. 0.8 m are used.

In the embodiment according to FIG. 1 a dome 5 is provided on the top region of melting gasifier 2, i.e. the upper termination thereof, centrally to and in the direction of the said longitudinal axis and constitutes a bell-shaped extension of the melting gasifier at this point. In the represented way, the inlet opening 3 for the gasification medium, i.e. coal, coke, etc. once again leads centrally and vertically into the dome 5, whilst the inlets 9 directly forming the discharge openings of screw conveyors 7 are at right angles thereto and therefore issue in the vicinity of the cylindrical side wall of dome 5. At a relatively long distance from the dome 5 and therefore inlets 9 and 3 is provided in the top region of the melting gasifier wall the arcuate arrangement of the outlets 6 for the crude or reduction gas.

The intake speed of the sponge iron into the melting gasifier 2 is determined by the lateral introduction thereof directly through the screw conveyors 7, i.e. solely through the throughput thereof, the sinking speed of the sponge iron within the downcomers 4 playing no part in this connection. The centrally combined addition within the dome 5 of both the gasification medium via inlet opening 3 and the hot sponge iron via discharge means 7 concentrates the dust formation of coal, coke, etc. within said dome 5 and is necessarily further entrained into the interior of the melting gasifier by the sponge iron. The sponge iron falls together with the gasification medium substantially centrally into the coal fluidized bed or also a solid bed of the melting gasifier 1, from where there is automatically a substantially homogeneous distribution. The outlet 6 bringing crude gas with a low dust content from the interior of the gasifier are positioned at an adequate distance from the central fall region of the coal and sponge iron and in fact are still in the top region of the melting gasifier.

For the case that the horizontal cross-section of the melting gasifier is not, as is usually the case, round and is instead oval or has another shape, several such domes 5 can be arranged in the top area of such a gasifier.

In the embodiment according to FIG. 2 there is no dome and, whilst retaining the vertical outlets 8 in the bottom of the direct reduction shaft furnace 1 for the connecting lines 4, the end thereof opposite to the outlets 8 issues into discharge means 7 arranged horizontally and radially to the longitudinal axis. The discharge means 7 constructed as screw conveyors otherwise correspond as regards arrangement and construction to those of FIG. 1. The discharge ends of the screw conveyors according to FIG. 2 issue into short, bent, but substantially vertical pipe sockets 10, which issued over a very short distance into the interior of the melting gasifier 1. Centrally with respect to the pipe sockets 10 arranged in a circle in the central top region of the melting gasifier is provided in aligned manner and in the direction of the longitudinal axis of gasifier 2 or shaft furnace 1 the inlet opening 3 for the gasification medium. Here again, the arrangement can be such that the distance between the inlet opening 3 and the inlets of the pipe sockets 10 arranged around the same is small compared with the distance from the outlets 6 for the crude or reduction gas. This leads to equivalent advantages to the embodiment of FIG. 1. Particularly through the considerable addition of sponge iron via the screw conveyors, there is a reduction to the intake speed into the gasifier, which leads to longer sponge iron resonance times in the hot fluidized bed in the gasifier formed from coke and/or coal lumps. If a solid bed gasifier is used, this correspondingly applies and leads to a better melting of the sponge iron.

I claim:

1. The combination of a direct reduction furnace, a melting gasifier and apparatus for charging the melting gasifier with sponge iron from the direct reduction shaft furnace arranged above the melting gasifier comprising:

a plurality of connecting means symmetrically arranged about a vertical longitudinal axis of the melting gasifier, each connecting means comprising a conduit having an inlet end connected to a lowermost end of the direct reduction shaft furnace, a substantially vertical portion of the conduit connected to the inlet end and extending downwardly therefrom, a substantially horizontal portion of the conduit having a first end connected to a lowermost end of the vertical portion and a second end, and an outlet connecting the second end of the conduit to an upper portion of the melting gasifier;

a discharge means situated within each of the horizontal portions of the conduits for assisting in delivering sponge iron from the lower end of the vertical portion of the connecting means to the outlet; and a gasification media inlet, situated on the longitudinal axis of the melting gasifier, adjacent to and centrally situated between the outlets of the plurality of connecting means.

2. Apparatus according to claim 1, wherein the melting gasifier includes a longitudinally situated dome-shaped extension connected to the discharge end of the plurality of discharge means and the gasification media inlet.

3. The combination of a direct reduction furnace, a melting gasifier and an apparatus for transporting a hot iron sponge from the direct reduction shaft furnace having a base to the melting gasifier disposed beneath the base of the direct reduction shaft furnace comprising a connecting means in the form of a conduit having an inlet end above the base of the direct reduction shaft furnace and an outlet end connected to the melting gasifier, and a discharge means having a first end connected to the direct reduction shaft furnace above the base and a discharge end connected to the inlet end of the connecting means, for removing the hot iron sponge from the reduction shaft furnace, the connecting means having an inlet end situated at the base of the reduction shaft furnace and the outlet end situated so that the length of the connecting means between the reduction shaft furnace and the melting gasifier is minimized and a dead volume in the reduction shaft furnace is avoided, the discharge means being connected to the outlet end of the connecting means at the first end and to the melting gasifier at a discharge end, and a gasification media inlet, situated on the longitudinal axis of the melting gasifier, adjacent and centrally situated to the discharge end of the discharge means so that the distribution of the hot sponge iron supplied to a melting gasifier is evenly distributed.

4. The combination of a direct reduction furnace comprising a generally vertically oriented shaft having a lowermost end including a plurality of outlets for sponge iron; a melting gasifier having a vertical longitudinal axis and situated below the direct reduction furnace comprising a gasification media inlet situated on the longitudinal axis of the melting gasifier at the upper end thereof, and a plurality of sponge iron inlets surrounding and situated adjacent to the gasification media inlet; and apparatus for charging the sponge iron inlets of the melting gasifier with sponge iron from the sponge iron outlets of the direct reduction furnace comprising a plurality of connecting means symmetrically arranged about the vertical longitudinal axis of the melting gasifier, each connecting means comprising a conduit having an inlet end connected to one of the sponge iron outlets of the direct reduction furnace, a substantially vertical portion of the conduit connected directly to the inlet end and extending downwardly therefrom, a substantially horizontal portion of the conduit having a first end connected to a lowermost end of the vertical portion and a second end connected to one of the sponge iron inlets of the melting gasifier, and a discharge means situated within each of the horizontal portions of the conduits for assisting in delivering sponge iron from the lower end of the vertical portion of the connecting means to the sponge iron inlet.

* * * * *